US009631319B2

(12) United States Patent
Gray

(10) Patent No.: US 9,631,319 B2
(45) Date of Patent: Apr. 25, 2017

(54) PROCESS FOR THE MANUFACTURE OF PAPER AND PAPERBOARD

(71) Applicant: BASF SE, Ludwigshafen (DE)

(72) Inventor: Christopher Alan Gray, Limburgerhof (DE)

(73) Assignee: BASF SE, Ludwigshafen (DE)

( * ) Notice: Subject to any disclaimer, the term of this patent is extended or adjusted under 35 U.S.C. 154(b) by 112 days.

(21) Appl. No.: 14/378,059

(22) PCT Filed: Feb. 25, 2013

(86) PCT No.: PCT/EP2013/053696

§ 371 (c)(1),
(2) Date: Aug. 11, 2014

(87) PCT Pub. No.: WO2013/127731

PCT Pub. Date: Sep. 6, 2013

(65) Prior Publication Data

US 2015/0027650 A1 Jan. 29, 2015

Related U.S. Application Data

(60) Provisional application No. 61/605,221, filed on Mar. 1, 2012.

(30) Foreign Application Priority Data

Mar. 1, 2012 (EP) ..... 12157692

(51) Int. Cl.

| | |
|---|---|
| ***D21H 17/00*** | (2006.01) |
| ***D21H 17/37*** | (2006.01) |
| ***D21H 17/45*** | (2006.01) |
| ***D21H 17/56*** | (2006.01) |
| ***D21H 17/65*** | (2006.01) |
| ***D21H 17/68*** | (2006.01) |
| ***D21H 21/10*** | (2006.01) |
| ***D21H 17/44*** | (2006.01) |
| ***D21H 17/55*** | (2006.01) |
| ***D21H 23/14*** | (2006.01) |
| ***D21H 23/16*** | (2006.01) |
| ***D21H 23/18*** | (2006.01) |

(52) U.S. Cl.

CPC ..... *D21H 17/74* (2013.01); *D21H 17/37* (2013.01); *D21H 17/44* (2013.01); *D21H 17/45* (2013.01); *D21H 17/455* (2013.01); *D21H 17/55* (2013.01); *D21H 17/56* (2013.01); *D21H 21/10* (2013.01); *D21H 23/14* (2013.01); *D21H 23/16* (2013.01); *D21H 23/18* (2013.01)

(58) Field of Classification Search

USPC .... 162/158, 164.2, 164.6, 166, 168.1–168.3, 162/181.1, 181.4–181.8, 183, 185

See application file for complete search history.

(56) References Cited

U.S. PATENT DOCUMENTS

| | | | | |
|---|---|---|---|---|
| 4,144,123 | A | 3/1979 | Scharf et al. | |
| 4,388,150 | A | 6/1983 | Sunden et al. | |
| 4,421,602 | A | 12/1983 | Brunnmueller et al. | |
| 4,795,531 | A * | 1/1989 | Sofia | D21H 23/765 162/164.6 |
| 5,061,346 | A * | 10/1991 | Taggart | D21H 17/00 162/175 |
| 5,176,891 | A | 1/1993 | Rushmere | |
| 5,266,164 | A | 11/1993 | Novak et al. | |
| 5,482,693 | A | 1/1996 | Rushmere et al. | |
| 5,536,370 | A | 7/1996 | Scherr et al. | |
| 5,641,855 | A | 6/1997 | Scherr et al. | |
| 6,048,438 | A * | 4/2000 | Rosencrance | D21H 23/14 162/158 |
| 6,056,967 | A | 5/2000 | Steuerle et al. | |
| 6,103,065 | A | 8/2000 | Humphreys et al. | |
| 6,454,902 | B1 * | 9/2002 | Chen | D21H 21/10 162/168.1 |

(Continued)

FOREIGN PATENT DOCUMENTS

| | | |
|---|---|---|
| DE | 24 34 816 A1 | 2/1976 |
| EP | 0 071 050 A1 | 2/1983 |

(Continued)

OTHER PUBLICATIONS

U.S. Appl. No. 14/373,174, filed Jul. 18, 2014, Gray, et al.
International Preliminary Report on Patentability issued Sep. 12, 2014 in PCT/EP2013/053696.
International Search Report and Written Opinion issued Jun. 3, 2013 in PCT/EP2013/053696.

(Continued)

*Primary Examiner* — Dennis Cordray
(74) *Attorney, Agent, or Firm* — Oblon, McClelland, Maier & Neustadt, L.L.P.

(57) ABSTRACT

The present invention concerns a process of making paper, board or paperboard in which a cellulosic thin stock is provided and subjected to one or more shear stages and then drained on a moving screen to form a sheet which is dried, wherein the process employs a treatment system which is applied to the thin stock, said treatment system comprising as components, a) a cationic organic polymer of charge density of at least 3.0 meq/g with a molar mass Mw of up to 3 million Daltons or poly aluminum chloride (PAC), b) a cationic polymer having an average molar mass Mw of at least 500,000 Daltons and a charge density not exceeding 4.0 meq/g; c) a microparticulate material; in which components (b) and (c) are added to the cellulosic thin stock after the last shear stage before the head box and component (a) is added to the cellulosic thin stock before the said last shear stage.

14 Claims, No Drawings

(56) References Cited

U.S. PATENT DOCUMENTS

| | | | | |
|---|---|---|---|---|
| 6,524,439 | B2 * | 2/2003 | Chen | D21H 21/10 162/168.1 |
| 6,706,190 | B1 | 3/2004 | Steuerle et al. | |
| 7,306,701 | B2 | 12/2007 | Blum et al. | |
| 7,998,314 | B2 * | 8/2011 | Koch | D21H 21/10 162/158 |
| 2005/0247420 | A1 | 11/2005 | Blum et al. | |
| 2008/0287596 | A1 | 11/2008 | Wester et al. | |

FOREIGN PATENT DOCUMENTS

| | | | |
|---|---|---|---|
| EP | 0 102 760 | A2 | 3/1984 |
| EP | 0 102 760 | A3 | 3/1984 |
| EP | 0 126 528 | A2 | 11/1984 |
| EP | 0 126 528 | A3 | 11/1984 |
| EP | 0 150 933 | A2 | 8/1985 |
| EP | 0 150 933 | A3 | 8/1985 |
| EP | 0 235 893 | A1 | 9/1987 |
| EP | 0 335 575 | A2 | 10/1989 |
| EP | 0 335 575 | A3 | 10/1989 |
| EP | 0 484 617 | A1 | 5/1992 |
| EP | 0 485 124 | A1 | 5/1992 |
| EP | 0 752 496 | A2 | 1/1997 |
| EP | 0 752 496 | A3 | 1/1997 |
| EP | 0 910 701 | A1 | 4/1999 |
| EP | 1 945 683 | B1 | 3/2010 |
| EP | 1 948 648 | B1 | 5/2010 |
| WO | WO 86/00100 | A1 | 1/1986 |
| WO | WO 94/12560 | A1 | 6/1994 |
| WO | WO 94/14873 | A1 | 7/1994 |
| WO | WO 97/25367 | A1 | 7/1997 |
| WO | WO 97/33040 | A1 | 9/1997 |
| WO | WO 97/33041 | A1 | 9/1997 |
| WO | WO 98/01623 | A1 | 1/1998 |
| WO | WO 99/16708 | A1 | 4/1999 |
| WO | WO 00/67884 | A1 | 11/2000 |
| WO | WO 2007/054444 | A2 | 5/2007 |

OTHER PUBLICATIONS

Ying Huang, et al., "Synthesis and characterization of bisacrylamide microgels containing sulfo groups", Makromol. Chem., vol. 186, 1985, pp. 273-281.

U.S. Appl. No. 14/760,381, filed Jul. 10, 2015, Gray, et al.

* cited by examiner

PROCESS FOR THE MANUFACTURE OF PAPER AND PAPERBOARD

The present invention relates to a method for the manufacture of paper and paperboard from a cellulosic suspension, employing a novel retention system.

It is well known to manufacture paper by a process that comprises flocculating a cellulosic thin stock by the addition of polymeric retention aid and then draining the flocculated suspension through a moving screen (often referred to as a machine wire) and then forming a wet sheet, which is then dried.

In order to increase output of paper many modern paper making machines operate at higher speeds. As a consequence of increased machine speeds a great deal of emphasis has been placed on drainage and retention systems that provide increased drainage. However, it is known that increasing the molecular weight of a polymeric retention aid which is added immediately prior to drainage will tend to increase the rate of drainage but damage formation. It is difficult to obtain the optimum balance of retention, drainage, drying and formation by adding a single polymeric retention aid and it is therefore common practice to add two separate materials in sequence.

EP-A-235893 provides a process wherein a water soluble substantially linear cationic polymer is applied to the paper making stock prior to a shear stage and then reflocculating by introducing bentonite after that shear stage. This process provides enhanced drainage and also good formation and retention. This process which is commercialised by BASF under the Hydrocol® (trade mark) has proved successful for more than two decades.

This Hydrocol® (trade mark) system of making paper is a very efficient microparticle system for a wide range of paper grades including fine paper, liner board and folding box board production. The benefits of this system include high retention levels, good drainage, good formation, good machine cleanliness, good runnability and a cost efficient system.

Subsequently, various attempts have been made to provide variations on this theme by making minor modifications to one or more of the components.

EP-A-335575 describes such a process in which a main polymer selected from cationic starch and high molecular weight water-soluble cationic polymer is added to a cellulosic suspension after which the suspension is passed through one or more shear stages followed by the addition of inorganic material selected from bentonite and colloidal silica. In this system a low molecular weight cationic polymer is added into the suspension before the addition of the main polymer. It is indicated that the low molecular weight polymer usually has a molecular weight below 500,000 and usually above 50,000, often above 100,000. Suggested low molecular weight cationic polymers include polyethyleneimine, polyamines, polymers of dicyandiamides-formaldehyde, polymers and copolymers of diallyl dimethyl ammonium chloride, of dialkyl amino alkyl (meth) acrylates and of dialkyl amino alkyl (meth) acrylamides (both generally as acid addition or quaternary ammonium salts). The process was said to improve processes in which there is a high amount of pitch or processes with a high cationic demand.

A further development of this type of process was subsequently disclosed in EP-A-910701 in which two different water-soluble cationic polymers or added in succession to pulps followed by subjecting the pulps to at least one shearing stage followed by the addition of bentonite, colloidal silica or clay. Specifically polyethyleneimines having a molar mass of more than 500,000 or polymers containing vinyl amine groups having a molar mass of between 5000 and 3 million are added to the pulp and then high molecular weight cationic polyacrylamides.

EP-A-752496 discloses a papermaking process in which a low molecular weight cationic polymer having a molecular weight below 700,000 and a cationic and/or amphoteric high molecular weight polymer are added simultaneously to the thin stock with anionic inorganic particles such as silica or bentonite being dosed into the thin stock suspension. The low molecular weight cationic polymer includes polyethyleneimine and polyvinyl amine. The polymers are generally added separately although it is indicated that the two cationic polymers can be added as a mixture. It is also indicated that the polymers can be added before a shear stage although the exact addition points are not indicated. It is stated that this process results in improved drainage and/or retention compare to processes in which the high molecular weight cationic or amphoteric polymer is used alone in conjunction with anionic inorganic particles.

U.S. Pat. No. 6,103,065 discloses a papermaking process involving the addition to a paper stock after the last point of high shear at least one high charge density cationic polymer of molecular weight between 100,000 and 2 million with a charge density in excess of 4 meq/g and either concurrently or subsequently adding at least one polymer having a molecular weight more than 2 million with a charge density below 4 meq/g. Subsequent to the two polymers a swellable bentonite clay is added to the stock. The high charge density polymer can be polyethyleneimine homopolymers or copolymers or polymers produced from vinyl amines. This document indicate that the process improves conventional bentonite programs by employing less polymer and improving press section dewatering which increases the solids entering the dryers thereby reducing the drying requirements. However, this process can sometimes suffer the disadvantage when making fine paper of a yellowing tendency.

U.S. Pat. No. 7,306,701 sought to provide a further improved papermaking process and in particular one in which the aforementioned yellowing tendency is avoided. The process disclosed employed a process for making paper, board or cardboard involving shearing a paper stock and then addition of a microparticle system comprising a cationic polymer and a finely divided inorganic component, such as bentonite, to the paper stock. Both the cationic polymer and finely divided inorganic component are added after the last shearing stage before the head box. The process further requires that the microparticle system is free of one or more polymers having a charge density of more than 4 meq/g.

In the production of paper, board and cardboard, despite all of the aforementioned developments, the machine speed can become limited by the amount of water retained in the fibre web after the press section when the machine is using maximum drying energy. The retention of fibre and filler particles is also limited when using standard retention and drainage aid (RDA) systems due to the potential paper quality issues. The retention and dewatering performance can be improved by using higher additions of standard RDA chemicals such as polyacrylamide and bentonite. Nevertheless, higher editions of these chemicals can negatively impact on the physical paper sheet properties, such as formation, strength and optical properties.

It would be desirable to provide a process in which the aforementioned disadvantage of limited machine speed is overcome without impacting on the physical paper sheet properties.

Thus according to the present invention we provide a process of making paper, board or paperboard in which a cellulosic thin stock is provided and subjected to one or more shear stages and then drained on a moving screen to form a sheet which is dried, wherein the process employs a treatment system which is applied to the thin stock, said treatment system comprising as components, a) a cationic organic polymer of charge density of at least 3.0 meq/g with a molar mass Mw of up to 3 million Daltons or polyaluminium chloride (PAC), b) a cationic polymer having an average molar mass Mw of at least 500,000 Daltons and a charge density not exceeding 4.0 meq/g;

c) a microparticulate material;

in which components (b) and (c) are added to the cellulosic thin stock after the last shear stage before the head box and component (a) is added to the cellulosic thin stock before that last shear stage.

The present invention has been found to provide improved retention and drainage performance without negatively impacting on the final paper properties.

Without being limited to theory is believed that the polyaluminium chloride or organic cationic polymer component (a) brings about an initial aggregation of the cellulosic solids and other stock components in the thin stock mainly by charge neutralisation. This treated thin stock passes through the last shearing stage before the head box which brings about some disruption of the aggregates which may enhance the effects of the cationic polymer component (b) and the microparticulate material component (c).

In accordance with the present invention the thin stock, which is often termed thin stock cellulosic suspension, may be provided by first forming a cellulosic thick stock suspension usually from at least one cellulosic stock component followed by dilution of the thick stock with dilution water. Desirably the thin stock may have a concentration of between 0.01% to as high as 2%, 2.5% or in some cases even 3%, based on the dry weight of solids on the total weight of thin stock. Often the concentration may be at least 0.05% or even at least 0.1%. Frequently the concentration of the thin stock may be at least 0.2% or at least 0.5% and in some cases may be at least 1%.

The thin stock may contain other components such as fillers, whitening agents, optical brightening agents, dyes etc.

The cellulosic thin stock suspension may contain mechanical fibre. By mechanical fibre we mean that the cellulosic suspension comprises mechanical pulp, indicating any wood pulp manufactured wholly or in part by a mechanical process, including stone ground wood (SGW), pressurised ground wood (PGW), thermomechanical pulp (TMP), chemithermomechanical pulp (CTMP) or bleached chemithermomechanical pulp (BCTMP). Mechanical paper grades contain different amounts of mechanical pulp, which is usually included in order to provide the desired optical and mechanical properties. In some cases the pulp used in making the filled paper may be formed of entirely of one or more of the aforementioned mechanical pulps. In addition to mechanical pulps other pulps are often included in the cellulosic suspension. Typically the other pulps may form at least 10% by weight of the total fibre content. These other pulps the included in the paper recipe include deinked pulp and sulphate pulp (often referred to as kraft pulp).

The thin stock suspension may also contain filler. The filler may be any traditionally used filler materials. For instance the filler may be clay such as kaolin, or the filler may be a calcium carbonate which could be ground calcium carbonate or in particular precipitated calcium carbonate, or it may be preferred to use titanium dioxide as the filler material. Examples of other filler materials also include synthetic polymeric fillers.

Generally a cellulosic stock comprising substantial quantities of filler are more difficult to flocculate. This is particularly true of fillers of very fine particle size, such as precipitated calcium carbonate. Thus according to a preferred aspect of the present invention we provide a process for making filled paper. The paper making stock may comprise any suitable amount of filler. Generally the cellulosic suspension comprises at least 5% by weight filler material. Typically the cellulosic suspension comprises up to 40% filler, preferably between 10% and 40% filler. Desirably the final sheet of paper or paper board comprises up to 40% by weight filler. In an alternative form of the invention form we provide a process of preparing paper or paperboard from a cellulosic stock suspension which is substantially free of filler.

In a process of making paper or paperboard there may be several shearing stages, selected from mixing, pumping and screening. Usual shearing stages include the one or more fan pumps or the one or more pressure screens. Typically the final shearing stage is often a pressure screen. Following this final shearing stage the thin stock may typically be fed into a headbox or constant flow box which delivers the thin stock onto the moving screen often termed machine wire.

The organic cationic polymer component (a) having a charge density of at least 3 mEq per gram may be any one of a number of types of cationic polymers. It may for instance be selected from the group consisting of polyethylenimines, polyamines, polyvinylamines, partially hydrolysed polyvinyl carboxamides, polymers of diallyl dimethyl ammonium chloride, cationic polyacrylamides and cationic polyacrylates.

The molar mass of the organic cationic polymer component (a) can be as high as 3,000,000 Da but is generally up to 2,000,000 Da or 2,500,000 Da. Suitably the molar mass may be at least 50,000 Da and suitably may be at least 100,000 Da. Frequently the molar mass may be at least 200,000 Da or even at least 500,000 Da. It may be desirably at least 750,000 Da and often at least 800,000 Da. Typically the molar mass will be at least 900,000 Da or even at least 1,000,000 Da or in some cases at least 1,100,000 Da. The molar mass may for instance be between 1,000,000 Da and 2,000,000 Da, for instance 1,100,000 Da to 1,800,000 Da. The charge density may be at least 3.5 mEq per gram or in some cases at least 4 mEq per gram. The charge density may for instance be any value higher than this for instance up to 8 or 10 mEq per gram or higher. Suitably this cationic polymer may be any of the polymers generally described as polyethyleneimines, polyamines, polymers of dicyandiamides with formaldehyde or even cationic vinyl addition polymers. Typical cationic vinyl addition polymers would include polymers of water-soluble cationic ethylenically unsaturated monomers. Typical cationic ethylenically unsaturated monomers include dimethyl ammonium halide (e.g. chloride), acid addition or quaternary ammonium salts of dialkyl amino alkyl (meth) acrylates and acid addition or quaternary ammonium salts of dialkyl amino alkyl (meth) acrylamides. Such polymers may be homopolymers of one or more of the cationic monomers or copolymers of one or more cationic monomers with non-ionic ethylenically unsaturated. Other cationic polymers include polymers of vinyl carboxamides, such as N-vinyl formamide, followed by partial or complete hydrolysis to yield vinyl amine units. Preferred polymers are selected from the group consisting of amino-containing polymers, in particular polyethyleneimines, modified polyethyleneimines, polyvinylamines, and partially hydrolysed polyvinyl carboxamides.

Polyethyleneimines or modified polyethylenimines may be as defined below include the nitrogen-containing condensation products described in German laid-open specification DE 24 34 816. These are obtained by reacting polyamidoamine compounds with polyalkylene oxide derivatives whose terminal hydroxyl groups have been reacted with epichlorohydrin. Other suitable polyethyleneimines are described in WO 97/25367 A1, WO 94/14873 A1, and WO 94/12560 A1. The polyethyleneimines or modified polyethyleneimines may be subsequently subjected to ultrafiltration as described in WO 00/67884 A1 and WO 97/23567 A1. Suitable polyethyleneimines and modified polyethyleneimines include polyalkylenimines, polyalkylene polyamines, polyamidoamines, polyalkylene glycol polyamines, polyamidoamines grafted with ethylenimine and subsequently reacted with at least difunctional crosslinkers, and mixtures and copolymers thereof.

Another preferred category of cationic polymers of charge density of at least 3 mEq per gram include partially hydrolysed polyvinyl carboxamides. More preferably these cationic polymers are homopolymers or copolymers of N-vinylformamide. These may be obtained by polymerizing N-vinylformamide to give homopolymers or by copolymerizing N-vinylformamide together with at least one other ethylenically unsaturated monomer. The vinylformamide units of these polymers are not hydrolyzed, in contradistinction to the preparation of polymers comprising vinylamine units. The copolymers may be cationic, anionic or amphoteric. Cationic polymers are obtained, for example, by copolymerizing N-vinylformamide with at least one other compatible ethylenically unsaturated water-soluble monomer, for instance acrylamide. Such polymers may for instance be produced as in aqueous solution, as a powder, as a reverse-phase emulsion or dispersion or as an aqueous dispersion.

Polymers comprising vinylformamide units are known. For instance, EP-A 0 071 050 describes linear basic polymers comprising 90 to 10 mol % of vinylamine units and 10 to 90 mol % of vinylformamide units. These polymers are produced by polymerizing N-vinylformamide by the solution polymerization process in water, the inverse suspension polymerization process, the water-in-oil emulsion polymerization process or the precipitation polymerization process and, in each case, subsequent partial detachment of formyl groups from the polyvinylformamides to form vinylamine units.

It is also suitable to produce a polymer powder comprising vinylformamide units by free radical polymerization of an aqueous solution of N-vinylformamide and if appropriate other monomers and drying the polymer. Typically this comprises an aqueous monomer solution comprising N-vinylformamide and at least one polymerization initiator being spray dispensed as an aerosol or dropletized at the top of a heatable tower-shaped reactor. Then the aerosol or droplets are polymerised in an inert gas atmosphere to form a finely divided solid followed by discharging the finely divided polymer from the reactor. This is for instance described in EP 1948648.

Another particularly desirable form of such poly vinyl carboxamides includes aqueous dispersions. Such an aqueous dispersions of water-soluble polymers of N-vinylcarboxamides, may be characterised in being substantially salt-free and comprising anionic polymeric stabilizers having a comb-like molecular structure. The aqueous dispersions may contain at least one polymeric stabilizer having a comb-like molecular structure, which is obtained by copolymerization of monomer mixtures comprising macromonomers and which is present as an anion under the polymerization conditions. The structure of the stabilizers can be described, for example, as a hydrocarbon backbone with anionic groups and nonpolar polyalkylene glycol side chains. In the aqueous polymerization medium, these stabilizers act, for example, as a stabilizer and/or as a precipitating agent for the polymer particles forming. These polymers may be obtained by copolymerization of monomer mixtures comprising macromonomers, for example as described in EP 1945683.

Mixtures of from 50 to 100% by weight of N-vinylformamide and from 0 to 50% by weight of one or more of said comonomers are suitable for the preparation of the water-soluble N-vinylcarboxamide polymers. The aqueous dispersions may be substantially salt-free. Here, "substantially salt-free" means that any amount of inorganic salts which is still present in the dispersions is very small, preferably less than about 1% by weight, particularly preferably less than 0.5% by weight and very particularly preferably less than 0.3% by weight in total, based in each case on the total weight of the aqueous dispersion. The aqueous dispersions of water-soluble polymers of N-vinylcarboxamides preferably have a high polymer content and preferably comprise polymers having high molar masses and simultaneously a low viscosity.

The organic cationic polymers of component (a) are frequently provided as aqueous solutions which it required can be further diluted to an appropriate concentration. Alternatively, the polymers may be provided in a different form, for instance water in water dispersions, solid grade powder or bead, reverse-phase emulsions. For such cases these polymers may be dissolved in water to form aqueous solutions. This may for instance be achieved in a suitable polymer solution make up device. Such equipment is described in the prior art and for instance commercialised by BASF under the trademark Jet Wet™.

Alternatively, component (a) may be polyaluminium chloride.

The cationic polymer of component (b) may be a suitable cationic polymer which has a charge density of below 4 meq/g. Suitably the polymer may be selected from the group consisting of cationic polyacrylamides, polymers containing vinyl amines units, cationic polyacrylates and polymers of diallyl dimethyl ammonium chloride.

Typically cationic polymer component (b) may have a charge density of below 3.5 mEq per gram and usually below 3.0 meq/g.

Desirably the polymers of component (b) may be prepared using a water-soluble ethylenically unsaturated monomer or blend of water-soluble ethylenically unsaturated monomers in which at least one of the monomers is cationic. Where the polymers are formed from more than one monomer the other monomers may be either cationic or non-ionic or a mixture. Nevertheless it is preferred that the two polymeric retention aids are formed entirely from cationic monomer or a mixture of monomers containing at least one cationic monomer and at least one non-ionic monomer.

The cationic monomers include dialkylamino alkyl (meth) acrylates, dialkylamino alkyl (meth) acrylamides, including acid addition and quaternary ammonium salts thereof, diallyl dimethyl ammonium chloride. Preferred cationic monomers include the methyl chloride quaternary ammonium salts of dimethylamino ethyl acrylate and dimethyl aminoethyl methacrylate. Suitable non-ionic monomers include unsaturated nonionic monomers, for instance acrylamide, methacrylamide, hydroxyethyl acrylate, N-vinylpyrrolidone. A particularly preferred polymer includes the copolymer of acrylamide with the methyl chloride quaternary ammonium salts of dimethylamino ethyl acrylate.

This cationic polymer preferably contains at least 5 mol % cationic monomer units and up to 60 mol % cationic monomer units, more preferably between 5 and 40 mol % cationic monomer units, especially between 5 and 20 mol %. A particularly preferred first polymeric retention aids are also cationic polyacrylamides comprising acrylamide and at least one water-soluble cationic ethylenically unsaturated monomer, preferably quaternary ammonium salts of dialkyl amino alkyl (meth)—acrylates or N-substituted—acrylamides, especially the methyl chloride quaternary ammonium salts of dimethylamino ethyl acrylate.

Generally these polymers of component (b) will tend to have a high molar mass, usually in excess of 500,000 Da and often at least 1,000,000 Da. Suitably polymers will exhibit an intrinsic viscosity of at least 3 dl/g and preferably at least 4 dl/g. In some cases the polymers may exhibit intrinsic viscosities of at least 5 and often at least 6 dl/g. In many cases it may be at least 7 or even at least 8.5 or 9 dl/g, and often at least 10 dl/g and more preferably at least 12 dl/g and particularly at least 14 or 15 dl/g. There is no maximum molecular weight necessary for this cationic polymer of component (b) and so there is no particular upper value of intrinsic viscosity. In fact the intrinsic viscosity may even be as high as 30 dl/g or higher. Generally though the first polymeric retention aid often has an intrinsic viscosity of up to 25 dl/g, for instance up to 20 dl/g.

Intrinsic viscosity of polymers may be determined by preparing an aqueous solution of the polymer (0.5-1% w/w) based on the active content of the polymer. 2 g of this 0.5-1% polymer solution is diluted to 100 ml in a volumetric flask with 50 ml of 2M sodium chloride solution that is buffered to pH 7.0 (using 1.56 g sodium dihydrogen phosphate and 32.26 g disodium hydrogen phosphate per liter of deionised water) and the whole is diluted to the 100 ml mark with deionised water. The intrinsic viscosity of the polymers is measured using a Number 1 suspended level viscometer at 25° C. in 1M buffered salt solution. Intrinsic viscosity values stated are determined according to this method unless otherwise stated.

Desirably the polymers of component (b) may be provided as reverse-phase emulsions prepared by reverse phase emulsion polymerisation, optionally followed by dehydration under reduced pressure and temperature and often referred to as azeotropic dehydration to form a dispersion of polymer particles in oil. Alternatively the polymer may be provided in the form of beads and prepared by reverse phase suspension polymerisation, or prepared as a powder by aqueous solution polymerisation followed by comminution, drying and then grinding. The polymers may be produced as beads by suspension polymerisation or as a water-in-oil emulsion or dispersion by water-in-oil emulsion polymerisation, for example according to a process defined by EP-A-150933, EP-A-102760 or EP-A-126528.

Typically the cationic polymer component (b) may be added to the thin stock as an aqueous solution. Suitably the polymer may be provided as an aqueous solution or in some other form which is dissolved in water to form an aqueous solution. Suitably aqueous solutions of the polymer may be achieved by individually dissolving the respective polymers into water. This may for instance be achieved in a suitable polymer solution make up device. Such equipment is described in the prior art and for instance commercialised by BASF under the trademark Jet Wet™.

The microparticulate material component (c) employed in the present invention may be any suitable finely divided particulate material. Suitably it may be selected from the group consisting of silica based particles, silica microgels, colloidal silica, silica sols, silica gels, polysilicates, cationic silica, aluminosilicates, polyaluminosilicates, borosilicates, polyborosilicates, zeolites, bentonite, hectorite, smectites, montmorillonites, nontronites, saponite, sauconite, hormites, attapulgites, sepiolites, anionic cross-linked polymeric microparticles of particle size below 750 nm and nanocellulose.

The silica may be for example any colloidal silica, for instance as described in WO-A-8600100. The polysilicate may be a colloidal silicic acid as described in U.S. Pat. No. 4,388,150. Polysilicates may be prepared by acidifying an aqueous solution of an alkali metal silicate. The polyaluminosilicates may be for instance aluminated polysilicic acid, made by first forming polysilicic acid microparticles and then post treating with aluminium salts, for instance as described in U.S. Pat. No. 5,176,891. Such polyaluminosilicates consist of silicic microparticles with the aluminium located preferentially at the surface.

Alternatively the polyaluminosilicates may be polyparticulate polysicilic microgels of surface area in excess of 1000 $m^2/g$ formed by reacting an alkali metal silicate with acid and water soluble aluminium salts, for instance as described in U.S. Pat. No. 5,482,693. Typically the polyaluminosilicates may have a mole ratio of alumina:silica of between 1:10 and 1:1500.

The siliceous material may be a colloidal borosilicate, for instance as described in WO-A-9916708.

The swellable clays may for instance be typically a bentonite type clay. The preferred clays are swellable in water and include clays which are naturally water swellable or clays which can be modified, for instance by ion exchange to render them water swellable. Suitable water swellable clays include but are not limited to clays often referred to as hectorite, smectites, montmorillonites, nontronites, saponite, sauconite, hormites, attapulgites and sepiolites. Typical anionic swelling clays are described in EP-A-235893 and EP-A-335575.

Most preferably the clay is a bentonite type clay. The bentonite may be provided as an alkali metal bentonite. Bentonites occur naturally either as alkaline bentonites, such as sodium bentonite or as the alkaline earth metal salt, usually the calcium or magnesium salt. Generally the alkaline earth metal bentonites are activated by treatment with sodium carbonate or sodium bicarbonate. Activated swellable bentonite clay is often supplied to the paper mill as dry powder. Flternatively the bentonite may be provided as a high solids flowable slurry, for example at least 15 or 20% solids, for instance as described in EP-A-485124, WO-A-9733040 and WO-A-9733041.

The cross-linked polymeric microparticles may be made as microemulsions by a process employing an aqueous solution comprising a cationic or anionic monomer and crosslinking agent; an oil comprising a saturated hydrocarbon; and an effective amount of a surfactant sufficient to produce particles of less than about 0.75 micron in unswollen number average particle size diameter. Microbeads are also made as microgels by procedures described by Ying Huang et. al., Makromol. Chem. 186, 273-281 (1985) or may be obtained commercially as microlatices. The term "microparticle", as used herein, is meant to include all of these configurations, i.e. microbeads per se, microgels and microlatices.

The polymeric microparticles of this invention are preferably prepared by polymerization of the monomers in an emulsion as disclosed in application, EP-484617. Polymerization in microemulsions and inverse emulsions may be used as is known to those skilled in this art.

It is preferred that the cationic organic polymer of component (a) has a higher charge density than the cationic polymer of component (b). In this respect the charge density of cationic organic polymer of component (a) preferably has a charge density at least 0.5 mEq per gram higher than the cationic polymer component (b). More preferably polymeric component (a) has a charge density of at least 1.0 mEq per gram, particularly at least 1.5 mEq per gram, especially at least 2.0 mEq per gram higher than that of cationic polymer component (b).

Desirably the cationic polymer of component (b) may have a higher molar mass than the cationic organic polymer of component (a). Preferably the molar mass of the component (b) polymer is at least 10% greater than the molar mass of the component (a) polymer. More preferably the molar mass of polymer of component (b) is at least 50%, in particular at least 100%, greater than the molar mass of the polymer of component (a). The molar mass of component (b) polymer may be up to 5 times greater, in some cases up to 10 times greater, and even up to 20 times greater or more, than the molar mass of the component (a) polymer.

More preferably the organic cationic polymer component (a) and cationic polymer component (b) will differ both in respect of higher charge density for component (a) and higher molar mass for component (b). More preferably still the differences of charge density and molar mass may be as indicated previously.

In the process according to the present invention the organic cationic polymer or poly aluminium chloride of component (a) can be added at any position into the thin stock up to the last shear stage before the headbox. For example, it may be dosed immediately after dilution of the thick stock.

In a typical process the paper machine may have one or more fan pumps for propelling the thin stock towards the final shearing stage occurring before the headbox. It may be desirable to add the component (a) to the thin stock anywhere between a fan pump and the aforementioned final shearing stage. Alternatively, where multiple fan pumps are employed for the thin stock stream, it may be desirable to introduce component (a) between any of the fan pumps.

Typically, the final shearing stage before the headbox could be the centri-screen sometimes known as the pressure screen.

Generally the dose of component (a) may be at least 0.005% (based on dry weight of thin stock) and often at least 0.01%. Frequently the dose may be at least 0.02% and in some cases at least 0.05%. The dose may be as high as 0.5% or higher but often will be up to 0.25% or 0.3%; in some cases it may be up to 0.2%.

The cationic polymer component (b) and the microparticulate material component (c) are both added to the thin stock subsequently final shear stage but before the headbox. The two components may be added in either order or alternatively substantially simultaneously, for instance by dosing at the same point to the thin stock. Desirably the cationic polymer component (b) is added to the thin stock before the microparticulate material.

Generally the dose of the cationic polymer of component (b) may be at least 0.005% (based on dry weight of thin stock) and often at least 0.01%. Often the dose may be at least 0.02% and in some cases at least 0.05%. The dose may be as high as 0.5% or higher but often will be up to 0.25% or 0.3%; in some cases it may be up to 0.2%.

The microparticulate material component (c) may be added to the thin stock if any amount of at least 0.01% by weight of dry thin stock. Preferably the amount of component (c) may be at least 0.02% and in some cases at least 0.05%. The dose may be at least 0.1% or at least 0.15% but in some cases could be up to 0.2%, up to 0.25% or up to 0.3%. It may be desirable for the dose to be as much as 0.5% or even up to 1.0% or more.

As an example a papermaking process a thin stock suspension having a consistency of 0.9% based on dry weight of solids onto total weight of suspension which suspension contains 30% of calcium carbonate is processed on a Fourdrinier machine with a hybrid former to produce a fine paper of printing quality.

A polyethylenimine of charge density 11 mEq per gram and molar mass of 800,000 Da is dosed into the thin stock at 0.03% by dry weight of thin stock immediately before the pressure screen (last shearing stage before the headbox). A commercial high molecular weight cationic polyacrylamide of average molar mass 6,000,000 Da and charge density of 2.0 mEq per gram is dosed immediately after the centri screen at a dose of 0.025% by weight of the thin stock. Subsequently bentonite (a microparticulate material) is dosed into the thin stock at 0.25% by weight of the thin stock.

EXAMPLE

A paper stock was prepared comprising a woodfree pulp containing 70% uncoated woodfree paper and 30% coated paper and including 15% ground calcium carbonate filler, 4.6 kg/t cationic starch, and 0.5 kg/t alkyl ketene dimer sizing agent. Calcium chloride was added to paper stock provide a conductivity of 2000 μS/cm which is typical for a paper mill furnish. The paper stock had a consistency of 0.99% and a total ash content of 28%.

The following additives were employed in the tests.

Product A A polyethylenimine with a molecular weight of 2 million and a cationic charge density of 6.5 meq/g Product B A copolymer of acrylamide with methyl chloride quaternised dimethyl amino ethyl acrylate having an intrinsic viscosity of above 7 dl/g and a cationic charge density of 1.2 meq/g.

Bentonite: sodium activated bentonite prepared at 5% and then diluted at 0.5% for ash retention tests.

The doses of chemical additives employed in the following tests, where employed, are as follows Product A 0.2%

Product B 0.025%

Bentonite 0.2%

Test 1 is the blank in which there were no chemical additives employed;

Test 2 (comparative) employed Product B followed by high-speed stirring at 1200 rpm for 30 seconds, representing the last shear stage, followed by bentonite;

Test 3 (comparative) employed Product B followed by light mixing followed by bentonite, representing adding both Product B and bentonite after the last shear stage;

Test 4 (comparative) employed Product A followed by high-speed stirring at 1200 rpm for 60 seconds, followed by Product B followed by high-speed stirring at 1200 rpm for 30 seconds, representing the last shear stage, followed by bentonite;

Test 5 (invention) employed Product A followed by high-speed stirring at 1200 rpm for 60 seconds, representing the last shear stage, followed by addition of Product B, followed by light mixing and then addition of bentonite, representing the addition of Product A before the last shear stage and the addition of Product B and bentonite after the last year stage.

The results are shown in Table 1

The ash retention tests are done with a DFR 04 from the company BTG (60 mesh copper screen). The ash retention is evaluated by the measurement of the total ash solids concentration found in a sample of 200 ml of white water (filtration of the white water made with an ash free filter paper type Whatmann 542). The First Pass Ash Retention (FPAR) is then determined by the following ratio:

FPAR (%)=([furnish ash conc. %]−[white water ash conc.])/[furnish conc.]

TABLE 1

| Test No | First Pass Ash Retention |
|---|---|
| 1 (Blank) | 24.4 |
| 2 (Comparative) | 63.6 |
| 3 (Comparative) | 71.2 |
| 4 (Comparative) | 61.5 |
| 5 (Invention) | 74.4 |

The invention claimed is:

1. A method of making paper, board or paperboard, said method comprising shearing a cellulosic thin stock in one or more stages to provide a sheared product, draining the sheared product on a moving screen to form a sheet, drying the sheet to produce the paper, board or paperboard, wherein a treatment is applied to the thin stock, said treatment system comprising a) a cationic organic polymer with a charge density of greater than 4 mEq/g and a molar mass Mw of up to 3 million Daltons, b) a cationic polymer with an average molar mass Mw of at least 500,000 Daltons and a charge density not exceeding 3.0 mEq/g, and c) a microparticulate material, and components (b) and (c) are added to the cellulosic thin stock after a last shear stage but before a head box, and component (a) is added to the cellulosic thin stock before said last shear stage.

2. The method according to claim 1 in which the cationic organic polymer of component (a) is selected from the group consisting of polyethylenimines, polyamines, polyvinylamines, partially hydrolysed polyvinyl carboxamides, polymers of diallyl dimethyl ammonium chloride, cationic polyacrylamides and cationic polyacrylates.

3. The method according to claim 1 in which component (b) is selected from the group consisting of cationic polyacrylamides, polymers containing vinyl amines units, cationic polyacrylates and polymers of diallyl dimethyl ammonium chloride.

4. The method according to claim 1 in which the microparticulate material is selected from the group consisting of silica based particles, silica microgels, colloidal silica, silica sols, silica gels, polysilicates, cationic silica, aluminosilicates, polyaluminosilicates, borosilicates, polyborosilicates, zeolites, bentonite, hectorite, somectites, montmorillonites, nontronites, saponite, sauconite, hormites, attapulgites, sepiolites, anionic cross-linked polymeric microparticles of particle size below 750 nm and nanocellulose.

5. The method according to claim 1 in which the cationic polymer component (b) is added to the thin stock before the microparticulate material.

6. The method according to claim 1 in which the cationic organic polymer of component (a) is added to the thin stock in an amount of from 0.005 to 0.5% by weight based on dry paper stock.

7. The method according to claim 6, in which the cationic organic polymer of component (a) is selected from the group consisting of polyethylenimines, polyamines, polyvinylamines, partially hydrolysed polyvinyl carboxamides, polymers of diallyl dimethyl ammonium chloride, cationic polyacrylamides and cationic polyacrylates.

8. The method according to claim 1 in which the cationic polymer component (b) is added to the thin stock in an amount of from 0.005 to 0.5% by weight based on dry paper stock.

9. The method according to claim 8, in which component (b) is selected from the group consisting of cationic polyacrylamides, polymers containing vinyl amines units, cationic polyacrylates and polymers of diallyl dimethyl ammonium chloride.

10. The method according to claim 1 in which the microparticulate material is added to the thin stock in an amount of from 0.01 to 1.0% by weight based on dry paper stock.

11. The method according to claim 1, in which the cationic organic polymer or poly aluminium chloride of component (a) is added to the thin stock in an amount of from 0.005 to 0.5% by weight based on dry paper stock and the cationic polymer component (b) is added to the thin stock in an amount of from 0.005 to 0.5% by weight based on dry paper stock.

12. The method according to claim 11, in which the cationic organic polymer of component (a) is selected from the group consisting of polyethylenimines, polyamines, polyvinylamines, partially hydrolysed polyvinyl carboxamides, polymers of diallyl dimethyl ammonium chloride, cationic polyacrylamides and cationic polyacrylates; and in which component (b) is selected from the group consisting of cationic polyacrylamides, polymers containing vinyl amines units, cationic polyacrylates and polymers of diallyl dimethyl ammonium chloride.

13. The method according to claim 12, in which the microparticulate material is selected from the group consisting of silica based particles, silica microgels, colloidal silica, silica sols, silica gels, polysilicates, cationic silica, aluminosilicates, polyaluminosilicates, borosilicates, polyborosilicates, zeolites, bentonite, hectorite, somectites, montmorillonites, nontronites, saponite, sauconite, hormites, attapulgites, sepiolites, anionic cross-linked polymeric microparticles of particle size below 750 nm and nanocellulose.

14. The method according to claim 11, in which the microparticulate material is selected from the group consisting of silica based particles, silica microgels, colloidal silica, silica sols, silica gels, polysilicates, cationic silica, aluminosilicates, polyaluminosilicates, borosilicates, polyborosilicates, zeolites, bentonite, hectorite, somectites, montmorillonites, nontronites, saponite, sauconite, hormites, attapulgites, sepiolites, anionic cross-linked polymeric microparticles of particle size below 750 nm and nanocellulose.

* * * * *